US010888187B2

(12) United States Patent
Yang et al.

(10) Patent No.: US 10,888,187 B2
(45) Date of Patent: Jan. 12, 2021

(54) MODULAR FOOD AND DRINK CARRIER

(71) Applicant: Huhtamaki, Inc., De Soto, KS (US)

(72) Inventors: Keegan Y. Yang, Winslow, ME (US); Donald V. Breton, N. Vassalboro, ME (US); William F. Bonczyk, Oakland, ME (US)

(73) Assignee: HUHTAMAKI, INC., De Soto, KS (US)

( * ) Notice: Subject to any disclaimer, the term of this patent is extended or adjusted under 35 U.S.C. 154(b) by 117 days.

(21) Appl. No.: 16/376,820

(22) Filed: Apr. 5, 2019

(65) Prior Publication Data

US 2019/0307277 A1 Oct. 10, 2019

Related U.S. Application Data

(60) Provisional application No. 62/654,162, filed on Apr. 6, 2018, provisional application No. 62/744,023, filed on Oct. 10, 2018.

(51) Int. Cl.
*A47G 23/06* (2006.01)
*B65D 25/06* (2006.01)

(52) U.S. Cl.
CPC ..... *A47G 23/0641* (2013.01); *B65D 25/06* (2013.01)

(58) Field of Classification Search
CPC ..... A47G 23/06; A47G 23/0641; B65D 1/34; B65D 1/36; B65D 25/06
USPC ..... 206/563, 564
See application file for complete search history.

(56) References Cited

U.S. PATENT DOCUMENTS

| | | | |
|---|---|---|---|
| D250,243 | S | 11/1978 | Vigue |
| 4,218,008 | A | 8/1980 | Veilleux |
| 5,857,583 | A | 1/1999 | Chantaca et al. |
| 6,076,876 | A | 6/2000 | Letourneau et al. |
| 6,089,366 | A | 7/2000 | Cheng |
| 6,520,366 | B1 | 2/2003 | Bradley et al. |
| 7,225,927 | B2 | 6/2007 | Sweeney |
| D614,047 | S | 4/2010 | Landry |

(Continued)

FOREIGN PATENT DOCUMENTS

| | | | | |
|---|---|---|---|---|
| EP | 1489014 | A1 * | 12/2004 | ..... B65D 1/36 |
| EP | 1489015 | A1 | 12/2004 | |

(Continued)

*Primary Examiner* — Bryon P Gehman
(74) *Attorney, Agent, or Firm* — Husch Blackwell LLP

(57) ABSTRACT

A modular food and/or drink carrier is provided. The modular carrier can be formed from one or more modular components that are interconnected together. Each modular carrier includes a receiving portion for receiving food and/or drink items and an overlapping portion for connecting to another modular component. Each modular component includes a first locking means formed from a protrusion and slot and a second locking means formed from an accordion component and a receiving slot. The first and second locking means provided on a first modular component interlock together with the first and second locking means provided on a second modular component when the two modular components are connected together. Each modular component can include a buttress support means that engages a portion of another modular component to provide additional support to the modular carrier when the two modular components are connected together.

18 Claims, 17 Drawing Sheets

(56) References Cited

U.S. PATENT DOCUMENTS

| | | | | |
|---|---|---|---|---|
| 7,735,640 | B2 | 6/2010 | Cook et al. | |
| 7,740,139 | B2 | 6/2010 | Cook et al. | |
| 8,302,801 | B2 | 11/2012 | Fried | |
| 8,544,915 | B1 | 10/2013 | Winkler | |
| 8,607,984 | B2 * | 12/2013 | Breton | B65D 1/36 206/563 |
| 8,684,222 | B2 | 4/2014 | Tesink et al. | |
| 9,051,102 | B2 | 6/2015 | Cook et al. | |
| 9,102,440 | B2 | 8/2015 | Cook et al. | |
| 9,327,889 | B2 | 5/2016 | Barkerding et al. | |
| 9,731,881 | B2 | 8/2017 | Barkerding et al. | |
| 9,955,806 | B2 | 5/2018 | Jaeckel | |
| 2007/0119724 | A1 | 5/2007 | Navarro Quesada | |
| 2009/0145305 | A1 | 6/2009 | Johanson et al. | |
| 2009/0211937 | A1 | 8/2009 | Sharma et al. | |
| 2010/0065562 | A1 | 3/2010 | Vovan | |
| 2011/0210038 | A1 | 9/2011 | Tesink et al. | |
| 2011/0278187 | A1 * | 11/2011 | Yang | B65D 71/70 206/427 |
| 2012/0228368 | A1 | 9/2012 | Stonehouse | |
| 2015/0272357 | A1 | 10/2015 | René Porté | |
| 2017/0050790 | A1 | 2/2017 | Barkerding et al. | |
| 2017/0099997 | A1 | 4/2017 | Buck | |
| 2017/0190461 | A1 | 7/2017 | Spivey, Sr. et al. | |

FOREIGN PATENT DOCUMENTS

| | | | | |
|---|---|---|---|---|
| EP | 1858380 | A2 | 11/2007 | |
| WO | WO-2006065132 | A2 * | 6/2006 | B65D 1/36 |

* cited by examiner

MODULAR FOOD AND DRINK CARRIER

CROSS-REFERENCE TO RELATED APPLICATIONS

This Application claims priority to U.S. Provisional Patent Application Ser. No. 62/654,162, filed on Apr. 6, 2018, to Keegan Yang et al., entitled "Modular Food and Drink Carrier," currently pending, the entire disclosure of which is incorporated herein by reference, and to U.S. Provisional Patent Application Ser. No. 62/744,023, filed on Oct. 10, 2018, to Keegan Yang et al., entitled "Modular Food and Drink Carrier with Buttress Support," currently pending, the entire disclosure of which is incorporated herein by reference.

BACKGROUND OF THE INVENTION

Food tray and multi-cup drink carriers are commonly used at sporting events, entertainment events, quick service restaurants and the like for allowing users to easily hold, carry and transport food and drink items, particularly when the user is transporting multiple foods and/or drink items at one time. Typically such carriers are constructed from molded fiber, folded paperboard or plastic and have only one configuration. For example, drink carriers are commonly configured as a four-cup carrier and food trays are configured to hold only a single food item. There are also commonly scenarios where a user is required to carry both food and drink items, and, as a result, various designs of food/drink carriers have been created for holding and carrying specific combinations of food and drink items. However, these designs allow for only a single specific combination and do not allow restaurants and vendors to utilize such a carrier for multiple combinations of food and drink items or food/drink items of varying shapes and sizes.

In an effort to solve this problem, there have been attempts to create connectable-type carriers that would allow multiple carriers to be connected together to hold increasing numbers of food/drink items. One such design is disclosed in U.S. Patent Application Publication No. 2009/0211937 to Sharma et al. entitled "Carriers for Cups," the entire disclosure of which is incorporated herein by reference. However, these connectable-type carriers have failed to provide a sufficiently rigid connection between the carriers, which has caused the carriers to fail and become disconnected when heavier items (such as large drink containers) have been placed therein. In addition, these designs have lacked the flexibility to allow for various types and configurations of carriers to be connected together to create different types of food/drink carriers depending on the specific items to be held and carried.

Thus, a need exists for a food/drink carrier that creates a sufficiently rigid connection to suitably hold various food/drink items and for a food/drink carrier that can be easily customized based on the number and types of items to be held and carried.

SUMMARY OF THE INVENTION

The present invention is directed to a modular carrier for holding food and/or drink items. The modular carrier may be formed from one or more modular components that are connected together in a partially overlapping manner. Modular carrier can have any number of configurations depending on the type, number and combination of modular components used for form modular carrier.

Each modular carrier can include a perimeter rim, a receiving portion and an overlapping portion. The receiving portion can include one or more container wells for holding containers and drink items, or receiving portion can include one or more food compartments for holding food items. The overlapping portion can include a central divider well, a first sidewall adjacent to the receiving portion, and a second sidewall extending from the divider well opposite the receiving portion. When two modular components are connected together, the overlapping portions of each modular component align and overlap one another and the first sidewall of the overlapped modular component aligns and overlaps the second sidewall of the underlapped modular component. Similarly, the second sidewall of the overlapped modular component aligns and overlaps the first sidewall of the underlapped modular component.

Each modular component can include a first locking means positioned within the divider well and a second locking means positioned on the first and second sidewalls. The first locking means includes a protrusion located on the edge of the divider well adjacent to the second sidewall and extending inward toward the center region of the divider well. The first locking means also includes a slot located on the side of the divider well opposite the protrusion. When two modular components are connected together, the protrusion of the underlapped modular component is inserted through the slot of the overlapped modular component to provide an interlocking fit between the two modular components.

The second locking means includes an accordion panel component formed into the second sidewall segment. The accordion panel component includes a two hinged panels provided within an opening in the second sidewall segment and connected together at the ends. The second locking means further includes a receiving slot located on the first sidewall segment that is sized and shaped to receive the accordion panel component. When two modular components are connected together, the accordion panel component of the overlapped modular component is inserted through the receiving slot of the underlapped modular component to provide an interlocking and interference fit. The accordion panel design allows the accordion panel to flex and expand within the receiving slot to maintain the sidewalls of the two modular components together.

The modular carrier can also include a buttress support means that is configured to function as a bracing mechanism to restrict bending and movement of the individual modular components when subjected to various loading conditions. The buttress support means can be formed into the outer edge of the divider well along upper end of the second sidewall and adjacent to the protrusion of the first locking means. The buttress support means includes an engaging edge configured to contact and engage the underlapped modular component when two modular components are connected together. The buttress support means is positioned next to the slot of the first locking means on the underlapped modular component when both modular components are connected together through the first and second locking means. When a rotational torque is applied to the modular components due to the loading condition of food, drink or other items being carried by the modular carrier, the buttress support means provides a brace structure that prevents the overlapped modular component and the underlapped modular component from rotating relative to one another due to the engagement of the buttress support means to the upper perimeter edge of the slot of the underlapped modular component.

The modular component of the present invention can be constructed from any type, combination and form of individual modular components, depending on the particular application and user. The first and second locking means formed into each modular component enable each modular component to be connected to an interlocked with a second modular component in order to provide a structurally sound and rigid modular carrier. The buttress support means can further be incorporated into each modular component to allow the modular components of a modular carrier to remain interlocked and connected during loading conditions that produce rotational torque onto the individual modular components.

Other and further objects of the invention, together with the features of novelty appurtenant thereto, will appear in the course of the following description.

DESCRIPTION OF THE SEVERAL VIEWS OF THE DRAWINGS

In the accompanying drawings, which form a part of the specification and are to be read in conjunction therewith in which like reference numerals are used to indicate like or similar parts in the various views.

DETAILED DESCRIPTION OF THE INVENTION

Figure 1:
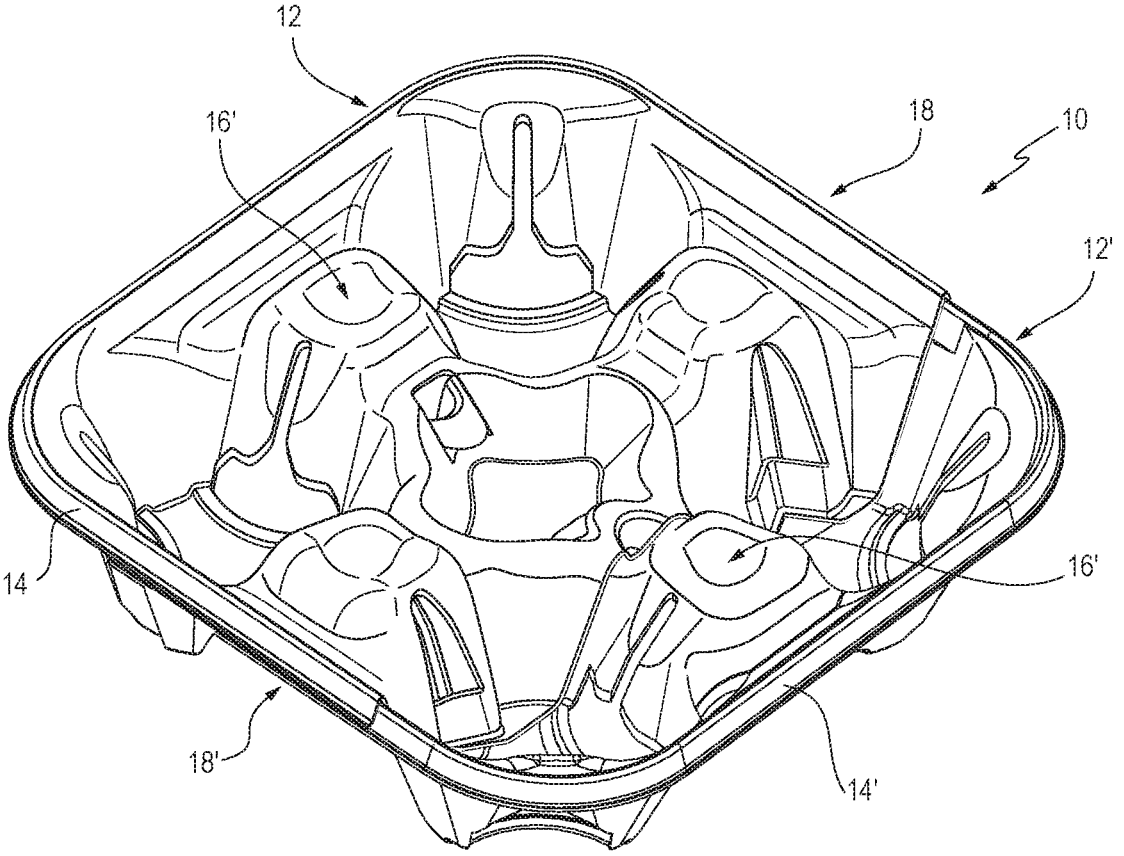
FIG. 1 is a perspective view of an assembled modular carrier in accordance with one embodiment of the present invention.

The invention will now be described with reference to the drawing figures, in which like reference numerals refer to like parts throughout. For purposes of clarity in illustrating the characteristics of the present invention, proportional relationships of the elements have not necessarily been maintained in the drawing figures. It will be appreciated that any dimensions included in the drawing figures are simply provided as examples and dimensions other than those provided therein are also within the scope of the invention.

The following detailed description of the invention references specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The present invention is defined by the appended claims and the description is, therefore, not to be taken in a limiting sense and shall not limit the scope of equivalents to which such claims are entitled.

The present invention is directed generally toward a modular carrier 10 that may be configured for holding, serving, transporting and/or carrying various food and/or drink items. As illustrated in the several figures, modular carrier 10 may be configured using one or more modular components 12 to create various different configurations with different shapes, styles and sizes depending on the particular use or desired application. As described in greater detail below, the modular components 12 can each be configured to partially overlap (or underlap) and interlock with one or more additional modular components 12 to create the specific configuration of modular carrier 10. In addition, modular carrier 10 can be configured using just a single modular component 12 (functioning independently) or two or more modular components 12 (connected together) depending on the various type and number of food and/or drink items the specific modular carrier 10 will be intended to hold or carry.

As illustrated throughout the figures, when modular carrier 10 is intended to hold only a limited number of drink containers or food items, modular carrier 10 may comprise just a single modular component 12, which can be held and carried by a user to transport the food or drink items. However, if modular carrier 10 is required to hold more food or drink items than a single modular component 12 can hold, two or more modular components 12 may be connected together in a partial overlapping relationship and interlocked together (as described in greater detail below) and the plurality of food and/or drink items can be held and carried by the modular carrier 10. Similarly, the use of modular components 12 can enable modular carrier 10 to be customized to the particular food and/or drink items to be carried by modular carrier 10. The modular components 12 can be interlocked together to create a single rigid and stable modular carrier 10 that maintains its shape when handling food or drink items of varying weight, even when the user holds the carrier 10 at only one of the modular components 12. Subsequently, once the user no longer needs the modular carrier 10, the modular components 12 can be separated back into individual components.

As also illustrated throughout the figures, each modular component 12 can be formed in a standardized form and shape to allow for the efficient creation of a number of different specific configurations of modular carrier 10. This can allow each modular component to be efficiently manufactured, transported and stored, and allow different configurations of modular components 12 to be compatible with one another. In addition, each modular component 12 may be made of any suitable material, and in one embodiment, may be formed from molded fiber.

Modular carrier 10 can be formed from multiple modular components 12 which are locked together using a first locking means 30 and a second locking means 32. Locking means 30 and 32 can function to secure different portions of modular components 12 together in order to maintain the strength and structural stability of modular carrier 10 under various loading conditions (resulting from the foods, drinks or other items being held by modular carrier 10).

The present invention is also directed generally toward a buttress support means 100 that may be configured for increasing the strength and rigidity of modular carrier 10 and connections therein, particularly when the upper end of the modular carrier 10 is placed in compression or otherwise subjected to compressive forces as a result of the handling of the modular carrier 10. Buttress support means 100 (along with locking means 30 and 32 as described herein) may be used to strengthen a modular carrier 10 formed from two or more modular components 12 interlocked together and may be particularly well-suited for use with modular components 12 constructed from molded fiber. It will be appreciated that buttress support means 100 along with first and second locking means 30 and 32 can be suitably used with any number of different types of modular components, including but not limited to, 2-cup carriers, 4-cup carriers, single-sided food trays, double-sided food trays, food trays with hinged clamshell or foldover lids, food trays with multiple compartments, food trays upwardly-extending dividing ribs adapted for keeping tacos in an upright position, along with any other suitable modular components that are currently known or hereafter developed, along with any number or combination of modular components.

FIG. 1 illustrates modular carrier 10 according to one embodiment of the present invention. As shown in FIG. 1, modular carrier 10 may comprise two modular components 12 and 12' that are connected and interlocked together to create modular carrier 10. Each modular component 12 can include an outer edge 14 defining the perimeter of the modular component 12, and a receiving region 16 and an overlapping region 18 provided within the outer edge 14. Receiving region 16 can be configured to hold and/or carry food or drink items and overlapping region 18 can be configured to overlap/underlap and interlock with the overlapping region 18' of the other modular component 12' as described in greater detail below. FIG. 1 illustrates modular carrier 10 where modular component 12 is in an overlapping configuration with respect to modular component 12'; however, the configuration of modular carrier 10 is interchangeable and modular components 12 and 12' can also be arranged where modular component 12 is in an underlapping configuration with respect to modular component 12'.

Figure 7:
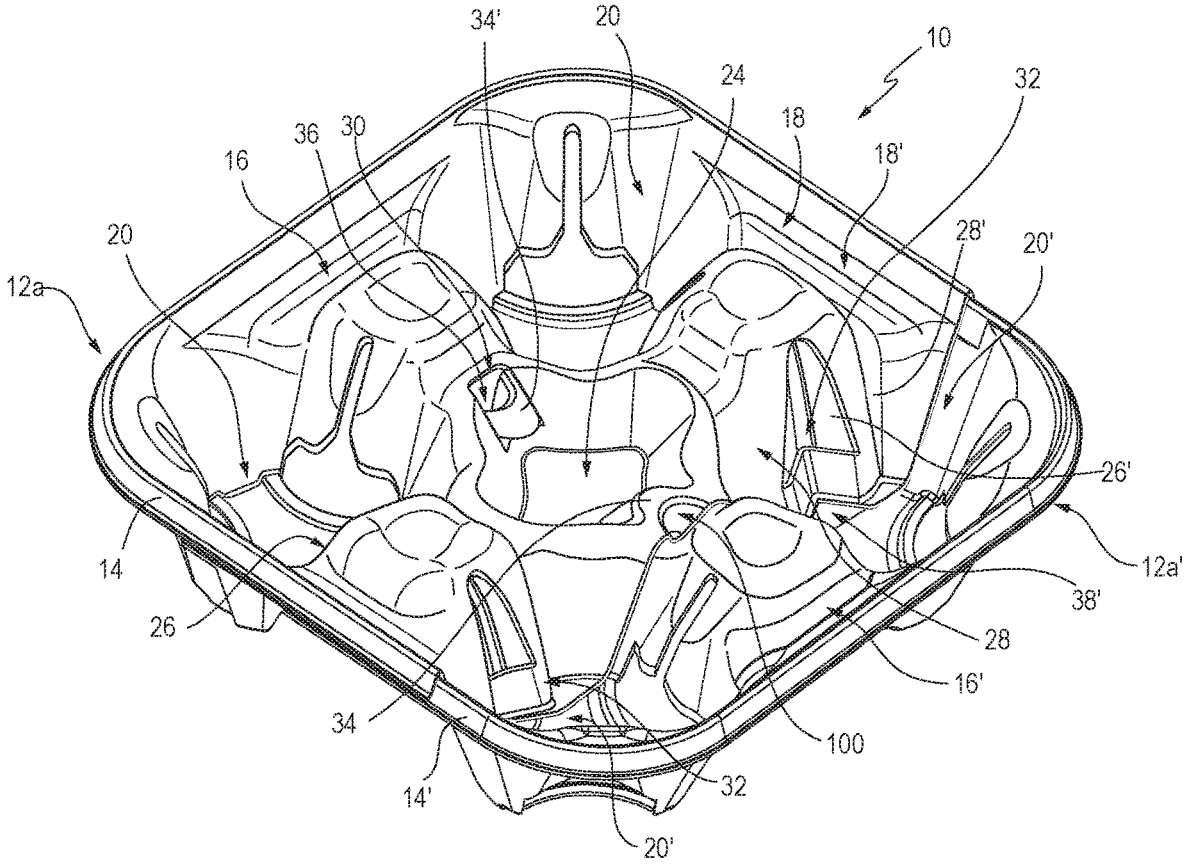
FIG. 7 is a perspective view of an assembled modular carrier formed from two modular components of from FIG. 2 in accordance with one embodiment of the present invention.
Figure 8:
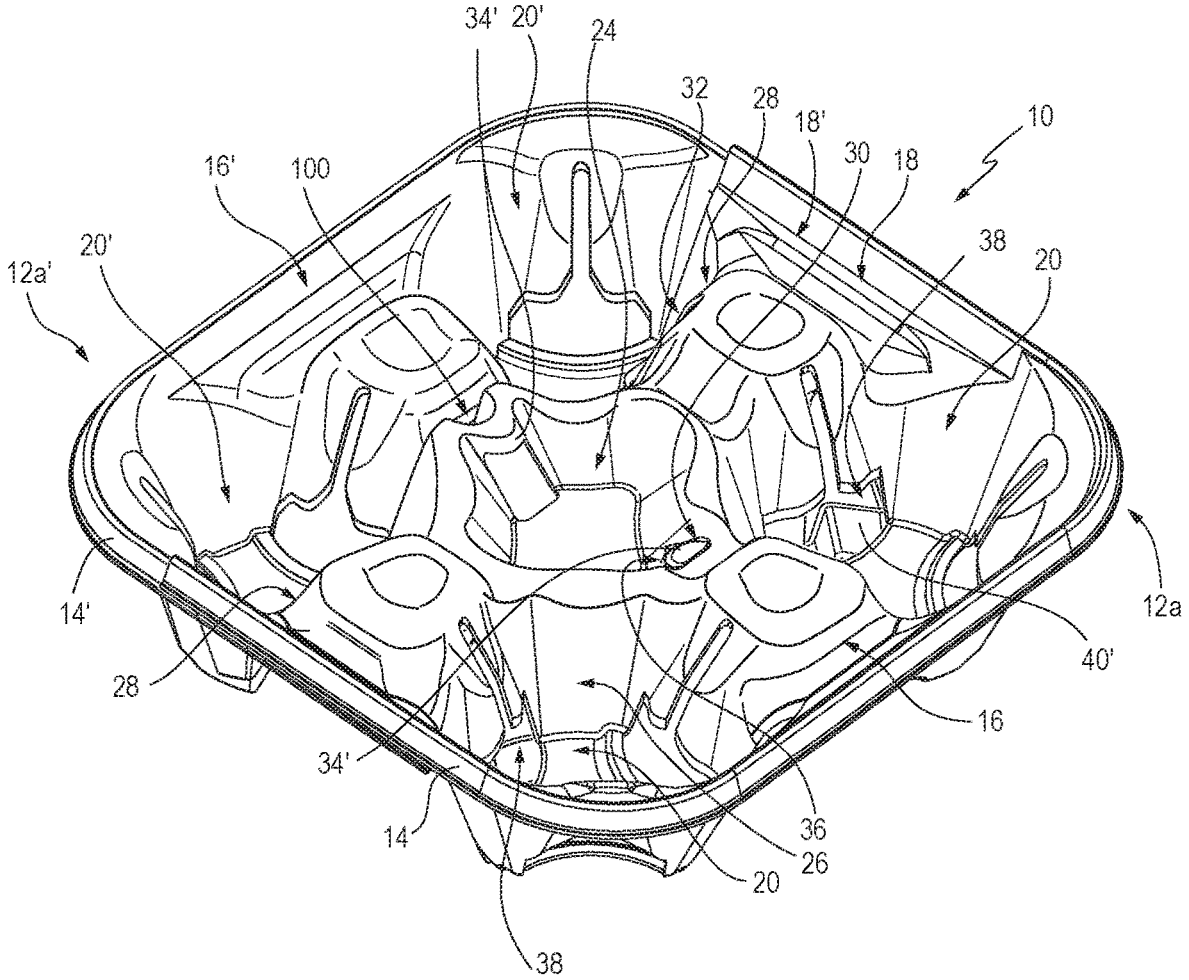
FIG. 8 is a front perspective view of the modular carrier of FIG. 7.
Figure 9:
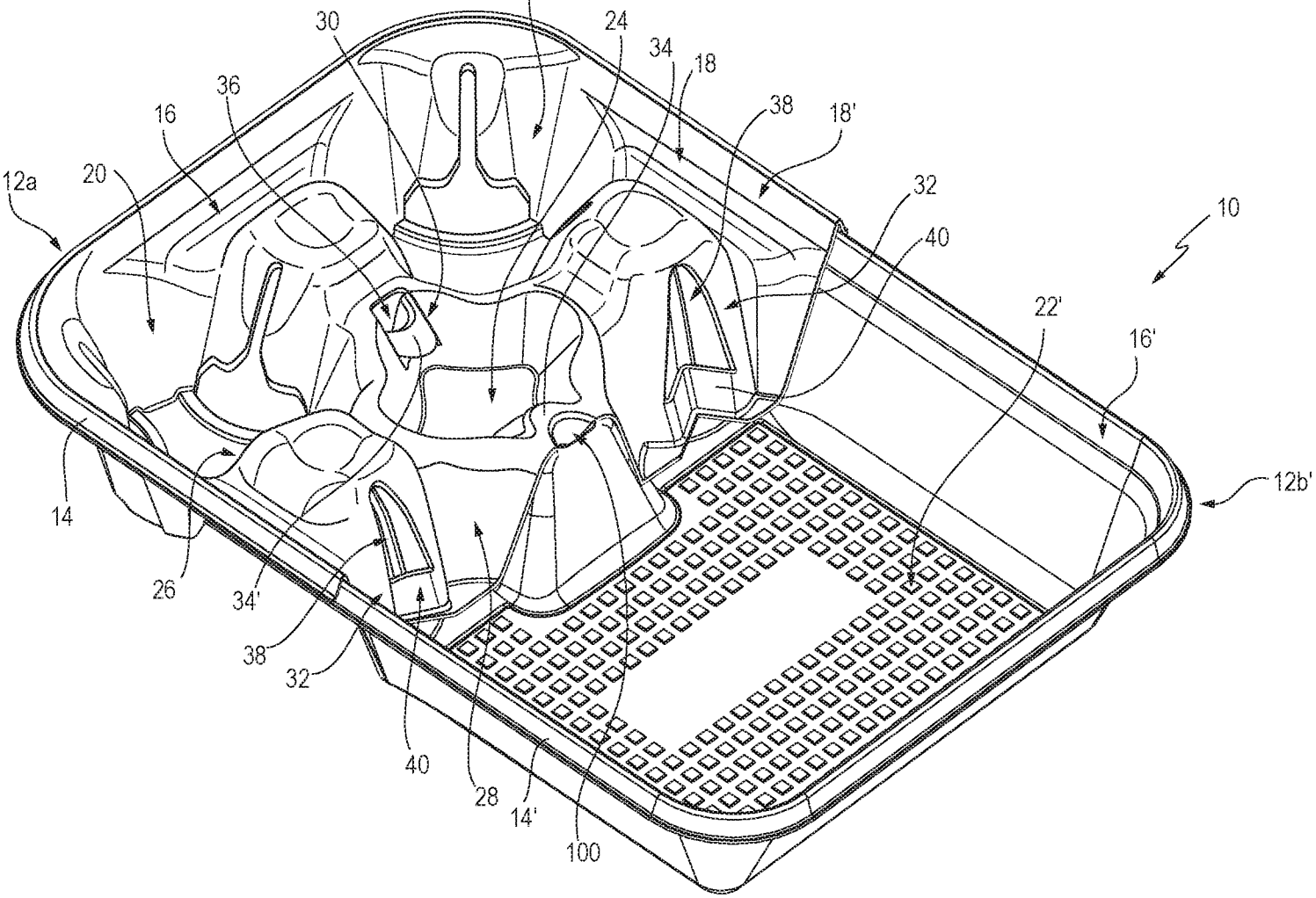
FIG. 9 is a perspective view of an assembled modular carrier formed from the modular component from FIG. 2 and the modular component from FIG. 4 in accordance with one embodiment of the present invention.
Figure 10:
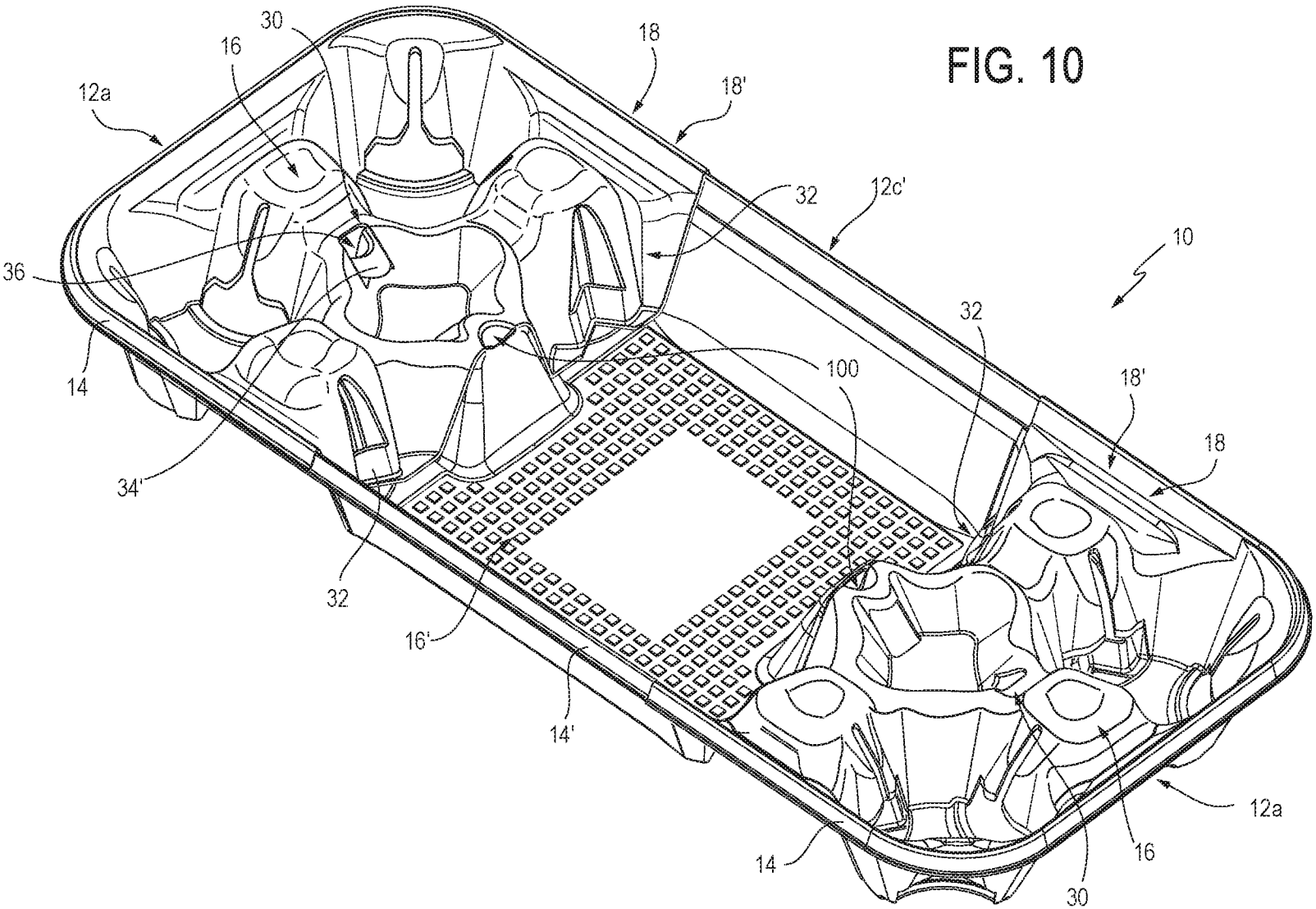
FIG. 10 is a perspective view of an assembled modular carrier formed from two of the modular components from FIG. 2 and one modular component from FIG. 6 in accordance with one embodiment of the present invention.

FIGS. 2-6 illustrate a modular component 12 in accordance with three different embodiments of the present invention. Each modular component 12 shown in FIGS. 2-6 (modular components 12*a*, 12*b* and 12*c*) can be utilized independently to create modular carrier 10. In addition (as illustrated in FIGS. 7-10), two or more modular components 12*a*, 12*b*, 12*c* may be connected together to form various combinations, each constituting a different embodiment of modular carrier 10. FIGS. 7-8 illustrate modular carrier 10 formed from two modular components 12*a*. FIG. 9 illustrates modular carrier 10 formed from one modular component 12*a* and one modular component 12*b*. FIG. 10 illustrates modular carrier 10 formed from two modular components 12*a* and one modular component 12*c*. Modular carrier 10 may also be constructed from any number of different combinations of modular components 12 (including different shapes of modular components not shown herein). In addition, any suitable number of number of modular components 12 (e.g., two, three, four, five, etc.) may be connected together to form the assembled modular carrier 10.

For example, according to one embodiment (not shown), modular carrier 10 can be configured with one modular component 12*c*, one modular component 12*a* and one modular component 12*b*. In another embodiment (not shown), modular carrier 10 can be configured with two modular components 12*b*. In yet another embodiment (not shown), modular carrier 10 can be configured with a modular component 12 (not shown) having three or more cup holders, or a modular component 12 (not shown) having two or more food tray compartments (such as a plurality of food compartments formed from holding ribs designed to hold individualized food items such as tacos and the like, or a modular component 12 (not shown) having both food and drink compartments, or any other desired shape or configuration of modular component 12.

As further illustrated by FIGS. 7-10, the modular components 12 used to construct modular carrier 10 may be connected together in alternative overlapping/underlapping arrangements. Accordingly, a first modular component 12*a*, 12*b* or 12*c* may be connected to a second modular component 12*a*', 12*b*' or 12*c*' by placing first modular component 12 in an underlapping arrangement with respect to second modular component 12', or first modular component 12 may be connected to second modular component 12' in an overlapping arrangement, depending on the desired configuration of the user. Each modular component 12 can be configured so that it can be positioned into an overlapping- or underlapping-connected relationship with a second modular component 12 without affecting the strength or rigidity of modular carrier 10.

Turning back to FIGS. 2-6, modular components 12 will be now be described in greater detail with reference to the figures. As shown in FIGS. 2-6, and described above, each modular component 12*a*, 12*b* and 12*c* can include an outer edge 14 defining the outer perimeter of the modular component 12. According to one embodiment (as best shown in FIG. 1), outer edge 14 can be configured as a lip or channel to enable the outer edge 14 of a first modular component 12 to engage and interlock with the outer edge 14' of a second modular component 12'.

Figure 2:
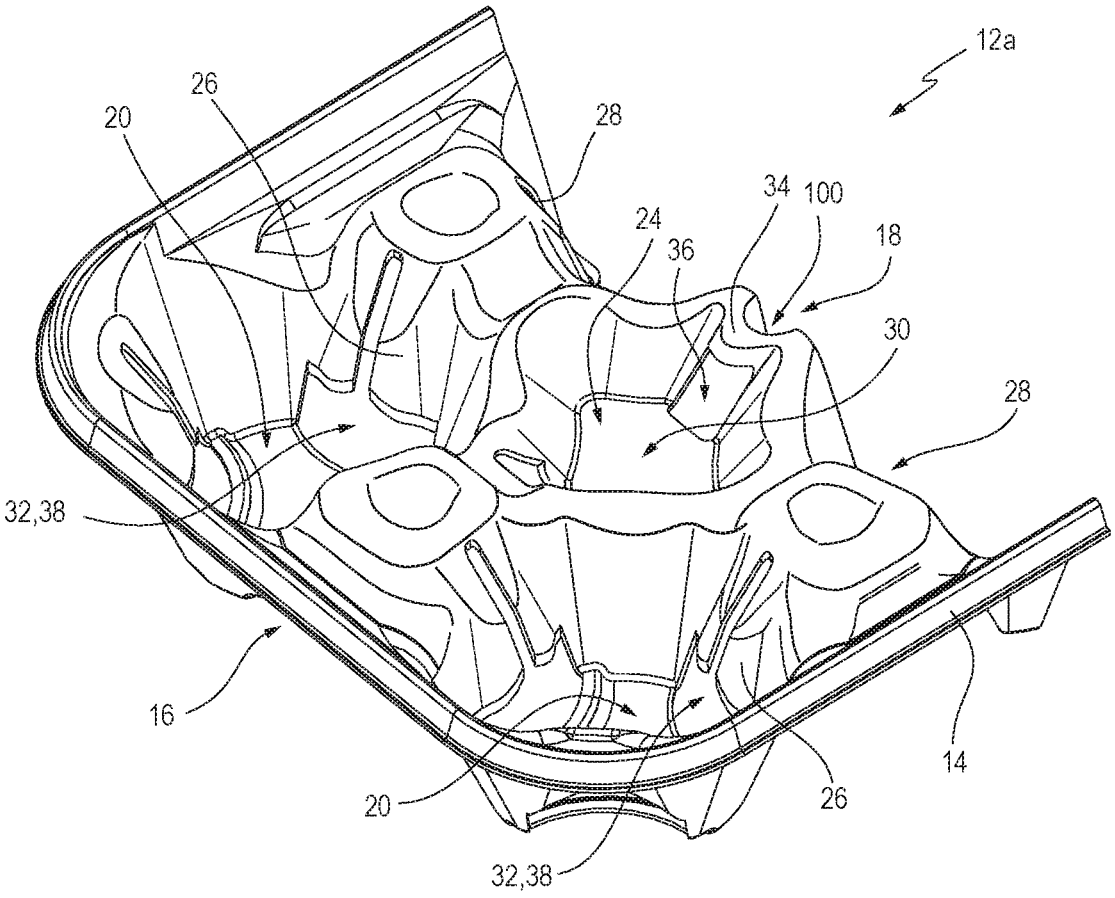
FIG. 2 is a perspective view of a first type of modular component used in a modular carrier in accordance with one embodiment of the present invention.
Figure 3:
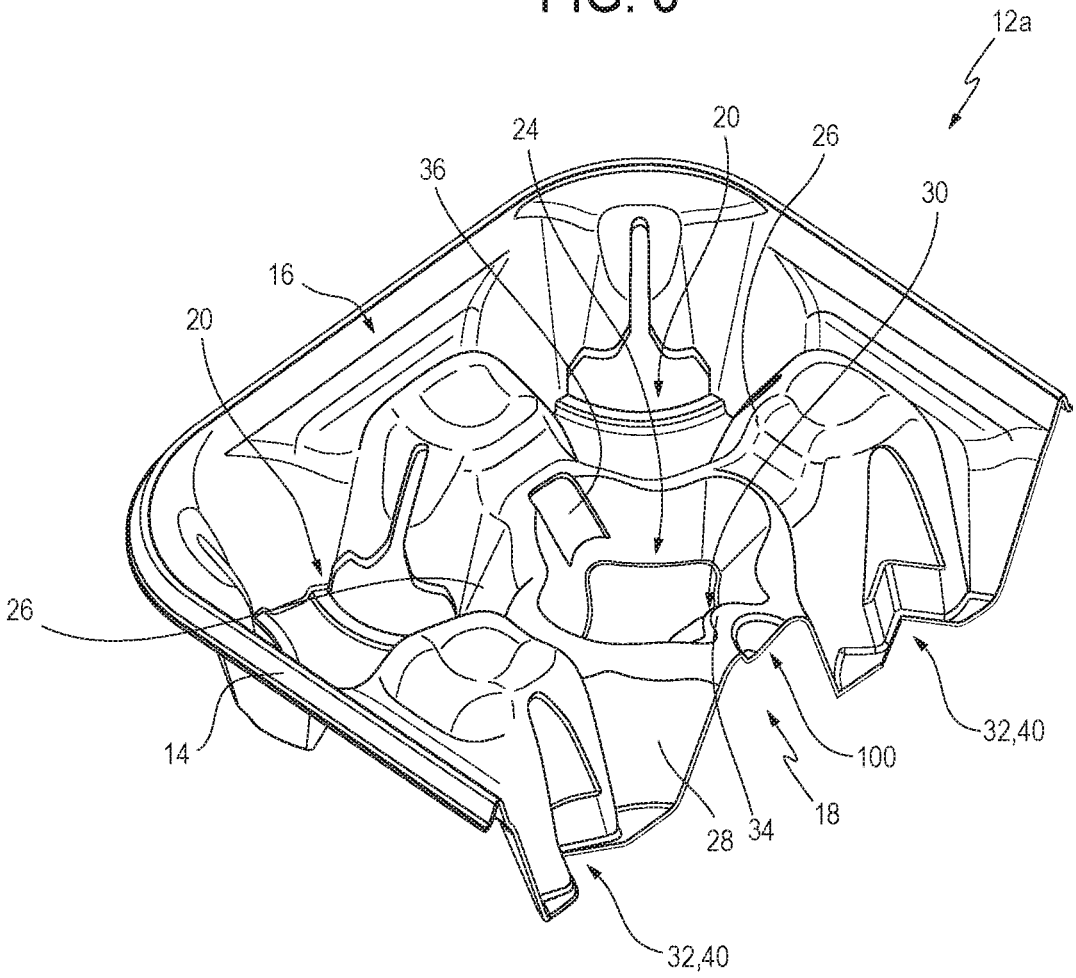
FIG. 3 is a front perspective view of the modular component of FIG. 2.

As further shown in FIGS. 2-6, each modular component 12*a*, 12*b* and 12*c* can include a receiving region 16 and an overlapping region 18. Receiving region 16 can be configured to include one or more compartments for holding and/or carrying food and/or drink items depending on the particular embodiment of modular component 12. As shown in FIGS. 2 and 3, the receiving region 16 of modular component 12*a* includes two cup or container wells 20 configured to hold cups and similar containers of varying shapes and sizes. As shown, each well 20 can include one or more slots to allow the well 20 to expand outward to accommodate containers of varying shapes and sizes. Such container well configurations are shown and described in U.S. Patent Publication No. 2009/0211937, which is incorporated herein by reference. As shown in FIGS. 2 and 3, the one or more slots in each well 20 can be configured as inverted "t-shaped" slots according to one embodiment. However, it is also recognized that the slots in each well 20 can have any desired or suitable shape in various alternative embodiments of the present invention.

Figure 4:
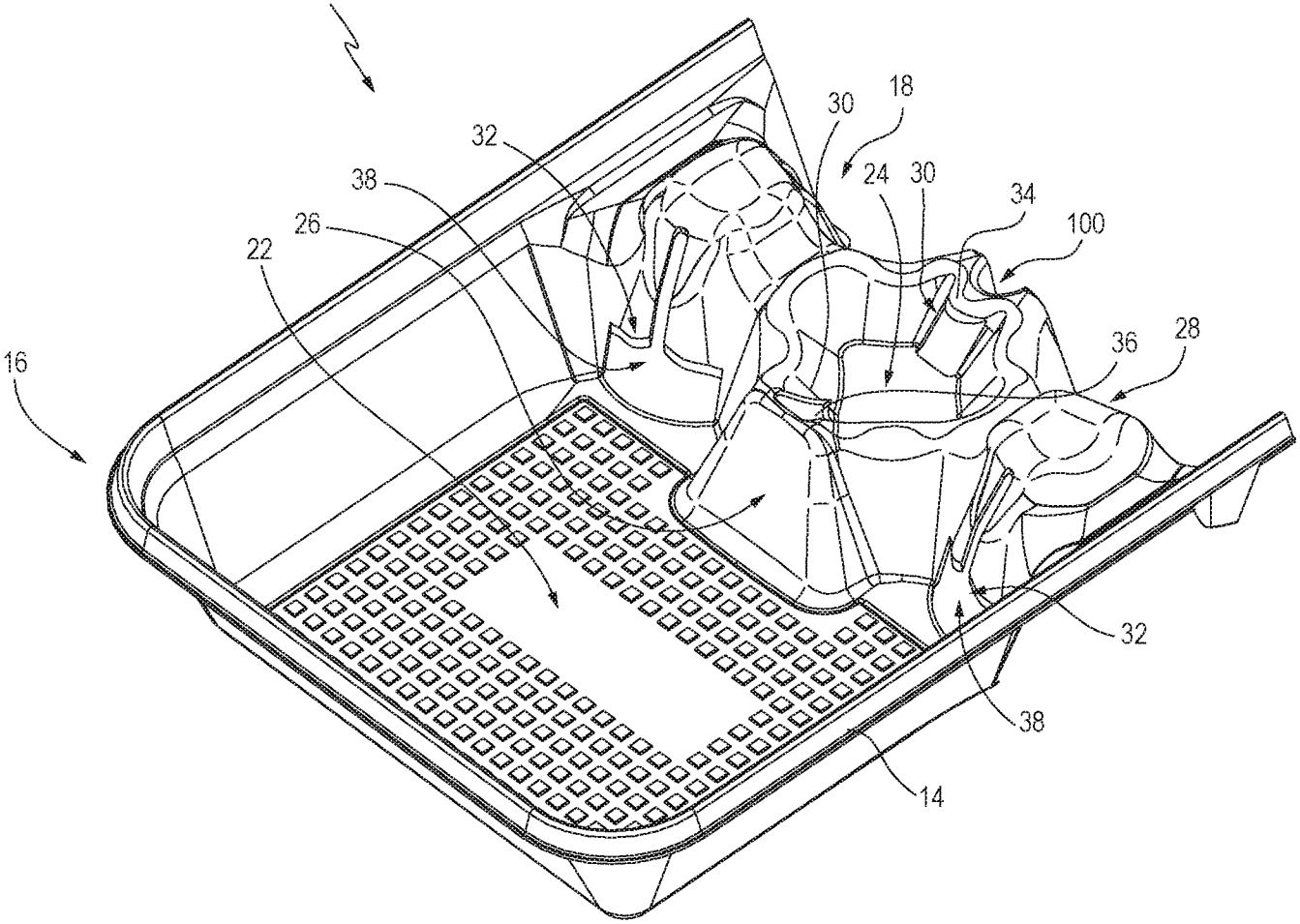
FIG. 4 is a perspective view of a second type of modular component used in a modular carrier in accordance with one embodiment of the present invention.
Figure 5:
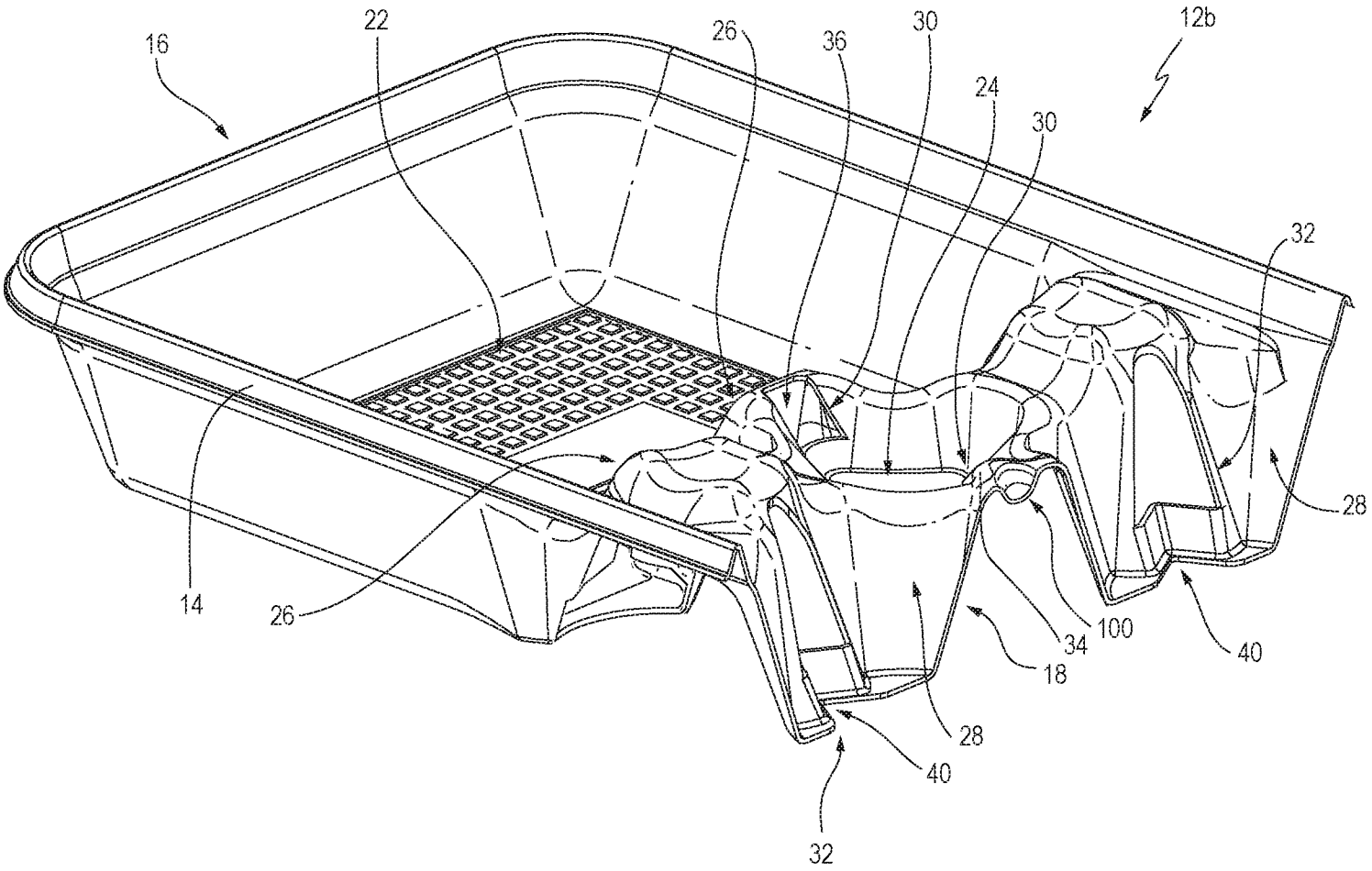
FIG. 5 is a front perspective view of the modular component of FIG. 4.
Figure 6:
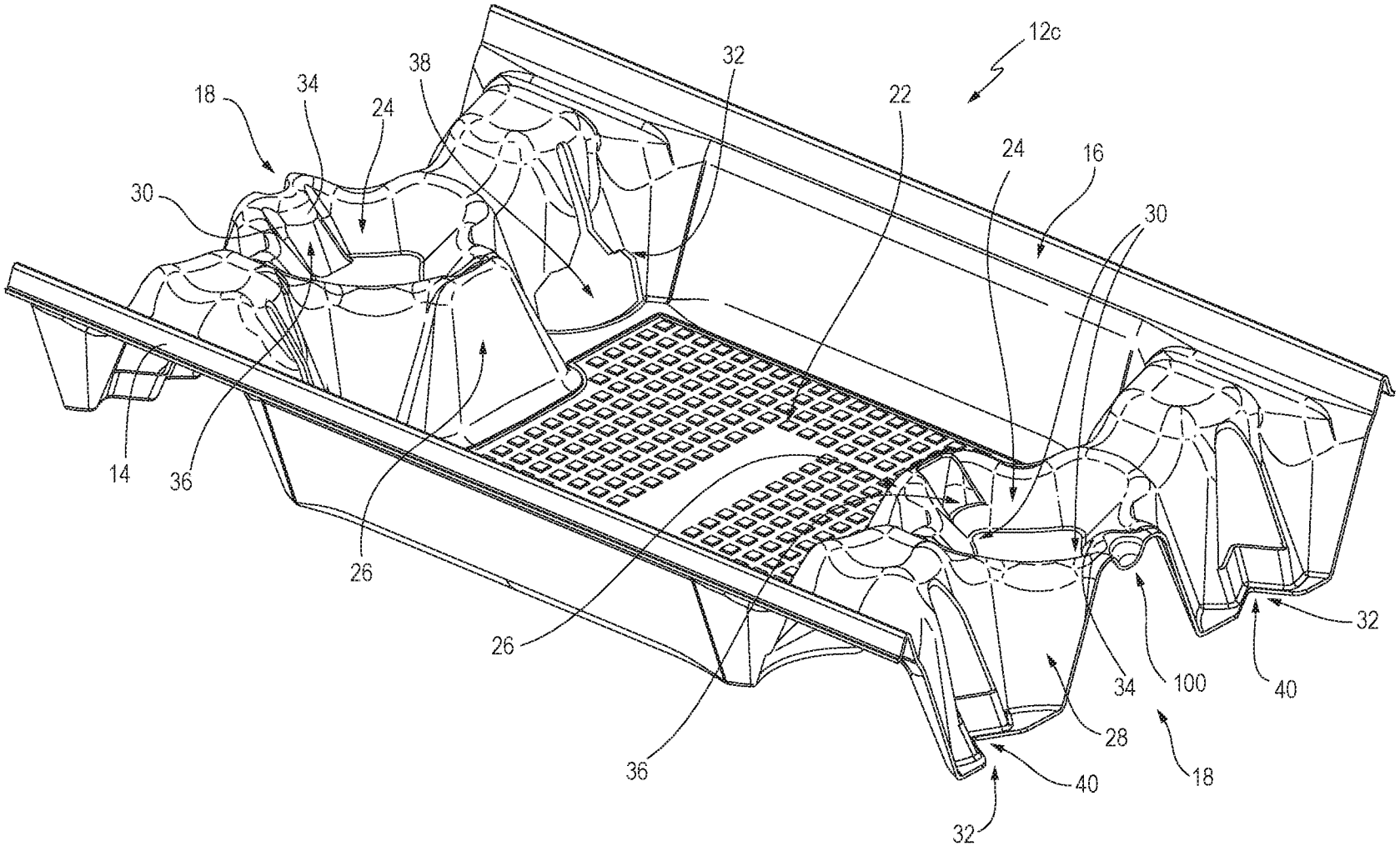
FIG. 6 is a perspective view of a third type of modular component used in a modular carrier in accordance with one embodiment of the present invention.

As shown in FIGS. 4-6, the receiving region 16 of modular components 12*b* and 12*c* can include a food compartment 22 configured for holding food items (including, but not limited to, hamburgers, hotdogs, sandwiches, tacos, burritos, pizza, meats, salads, fruits, vegetables, fries, onion rings, potato wedges, chips, chicken nuggets, tenders, mozzarella sticks, other finger foods, desserts, and the like) and/or containers of various shapes and sizes. FIGS. 4-6 illustrate food compartment 22 as a flattened tray; however, it is recognized that food component 22 can have any desired shape and configuration depending on the particular embodiment of the present invention. For example, food compartment 22 may be configured with one or more dividing or holding ribs that separate food compartment 22 into individual zones for holding individualized food items, such as tacos, hotdogs and the like, and/or assist in keeping such food items in an upright position. Additionally, food compartment 22 may include a hinged clamshell lid or other foldable lid that may be adapted for being closed to cover or secure the contents therein.

As further shown in FIGS. 2-6, the overlapping region 18 of each modular component 12*a*, 12*b* and 12*c* can include a divider well 24 and first and second sidewall segments 26 and 28 located on each side of divider well 24. As best shown in FIGS. 2 and 4, first sidewall segment 26 can be adjacent to and connect divider well 24 (and overlapping region 18) to the receiving region 16 of modular component 12. As best shown in FIGS. 3 and 5, second sidewall segment 28 can extend from divider well 24 opposite of first sidewall segment 26 and can generally conform to the shape and contour of first sidewall segment 26 in order to allow for a conforming and interlocking fit between the second sidewall segment 28 of a first modular component 12 and the first sidewall segment 26 of a second modular component 12 when the two modular components 12 are connected together to form modular carrier 10 (see FIGS. 7-10). As illustrated by FIGS. 7-10, when two modular components 12 are connected together, the first sidewall segment 26 of the overlapping modular component 12 will align with and overlap the second sidewall 28 of the underlapping modular component 12, and the second sidewall segment 28 of the overlapping modular component 12 will align with and overlap the first sidewall segment of 26 of the underlapping modular component 12.

As further shown in FIGS. 2-6, the overlapping region 18 of each modular component 12*a*, 12*b* and 12*c* can include a first locking means 30 located on divider well 24 and a second locking means 32 located on each of the first and second sidewall segments 26 and 28. First and second locking means 30 and 32 can be configured to interlock and secure together two modular components 12 when connected together to form modular carrier 10 as best shown in FIGS. 7-10. As shown in FIGS. 2-6, first locking means 30 may comprise a protrusion 34 and corresponding slot 36 located along the sides of divider well 24. As shown in FIGS. 2-6, protrusion 34 can be located on the side of divider well 24 adjacent to second sidewall segment 28 and corresponding slot 36 can be located on the opposite side of divider well 24 adjacent to first sidewall segment 26. As also shown in FIGS. 2-6, modular component 12 can include an additional slot positioned below protrusion 34 which need not necessarily form part of first locking means 30.

As best shown in FIGS. 7-10, when a first modular component 12 (shown as the overlapping modular component in this embodiment) is connected to a second modular component 12' (shown as the underlapping modular component in this embodiment) by overlapping the overlapping regions 18 of each modular component 12 and 12', the protrusion 34' of the second modular component 12' can be inserted into the slot 36 of the first modular component 12. In this arrangement, the protrusion 34' of modular component 12' that is positioned below the other modular component 12 (i.e., modular component 12' underlaps modular component 12) is positioned through slot 36 of modular component 12 (i.e., the overlapped modular component 12). Such a configuration can operate to effectively interlock the modular components 12 and 12' together and secure the modular components 12 and 12' in place to form modular carrier 10. In addition, as further illustrated in FIGS. 7-10, the protrusion 34 of modular component 12 (i.e., the overlapped modular component 12) can be positioned adjacent to (but not through) the slot 36' of modular component 12' (i.e., the underlapped modular component 12'). As described in greater detail below, buttress support means 100 (which can be located on the exterior side of protrusion 34) can then engage the perimeter edge of slot 36' to provide facilitate in strengthening and maintaining the interlocking connection between modular components 12 forming modular carrier 10.

As best shown in FIGS. 2-6, second locking means 32 may comprise a receiving slot 38 located on first sidewall segment 26 (as best illustrated in FIGS. 2 and 4) and an accordion panel component 40 located on second sidewall segment 28 (as best illustrated in FIGS. 3 and 5). As best shown in FIGS. 7-10, when a first modular component 12 is connected to a second modular component 12' (by overlapping the overlapping regions 18 of each modular component 12 and 12'), the accordion panel 40 of modular component 12 may be received within the receiving slot 38' of modular component 12' when the overlapping regions 18 are connected together and the second sidewall segment 28 of modular component 12 is aligned with the first sidewall segment 26' of modular component 12'. As best illustrated in FIGS. 7 and 9, the accordion panel 40 of the overlapping modular component 12 extends through the receiving slot 38' of the underlapping modular component 12' within the container wells 20' (see FIG. 7) or food compartment 22' (see FIG. 9) of the underlapping modular component 12'.

As described in greater detail below, when accordion panel 40 is received within receiving slot 38', an interference fit is formed, thereby securing the first and second sidewall segments 26' and 28 of the modular components 12 and 12' together so that modular components 12 and 12' remain connected together to form modular carrier 10. As further described below, the accordion panel component 40 is designed to have structural integrity and rigidity in a generally vertical or longitudinal direction and be relatively weak in a generally horizontal or transverse direction. This permits the accordion panel component 40 to serve as a latch in the vertical direction while having a desired degree of flexibility in the horizontal direction such that the accordion panel component 40 is adapted for projecting through a receiving slot 38.

FIGS. 7-10 illustrate modular carrier 10 in various configurations after being formed by connecting two or more modular components 12 together. With reference to FIGS. 7 and 8, a first modular component 12*a* can be positioned partially over a second modular component 12*a'* so that the overlapping regions 18 (and 18') of each modular component 12*a* and 12*a'* are aligned. As shown in FIGS. 7 and 8, the outer edge 14 of the first modular component 12*a* can receive the outer edge 14' of the second modular component 12*a'* along the overlapping regions 18 and 18' to improve the rigidity and stabilize the connection between the modular components 12*a* and 12*a'*. As further shown in FIGS. 7 and 8, divider wells 24 and 24' generally conform and overlap one another so that the protrusion 34' of second modular component 12*a'* is positioned through the corresponding slot 36 of the first modular component 12*a* in order to form the first locking means 30 (as best shown in FIG. 7), which can increase the rigidity and stabilize the modular carrier 10 by resisting pivoting or movement of one modular component 12 with respect to the other. In addition (as described in greater detail below), the buttress support means 100 adjacent to protrusion 34 of the first modular component 12*a* can engage the edge of slot 36' of the second modular component 12*a'* to further stabilized and support modular carrier 10.

FIGS. 7-10 further illustrate the conforming fit between the first and second sidewall segments 26 and 28 of modular components 12 and 12' when they are connected together to form modular carrier 10 in accordance with one embodiment of the present invention. As shown, the second sidewall segment 28 of first modular component 12 generally conforms to the shape and contours of the first sidewall segment 26' of the second modular component 12' in order to allow second sidewall segment 28 to align with and substantially overlap the first sidewall segment 26'. For example, as shown in FIG. 7, second sidewall segment 28 (of overlapping modular component 12*a*) includes a raised portion to correspond to the raised portion of first sidewall segment 26' (of underlapping modular component 12*a'*) extending from the divider well 24' to separate container wells 20'. In a similar fashion (as best shown in FIG. 9), the first sidewall segment 26 (adjacent to receiving region 16) of second (underlapping) modular component 12*b'* generally conforms to the shape and contours of second sidewall segment 28 (opposite receiving region 16) of first (overlapping) modular component 12*a* in order to allow the first sidewall segment 26' to align with and substantially overlap the second sidewall segment 28.

By providing first and second sidewall segments 26 and 28 of each modular component 12 with similar and generally conforming shapes and structures, each modular component 12 can be overlapped and connected to a second modular component 12 by placing together the overlapping regions 18 of the modular components 12. This further allows the first and second locking means 30 and 32 (along with the outer edges 14) of each modular component to be utilized to create an interlocking fit and maintain modular carrier 10 in a fixed position without pivoting or movement of the individual modular components 12. As shown throughout FIGS. 7-10, multiple configurations of modular carrier 10 can be created using various combinations of modular component 12, depending on the desired use and application of modular carrier 10.

Figure 11A:
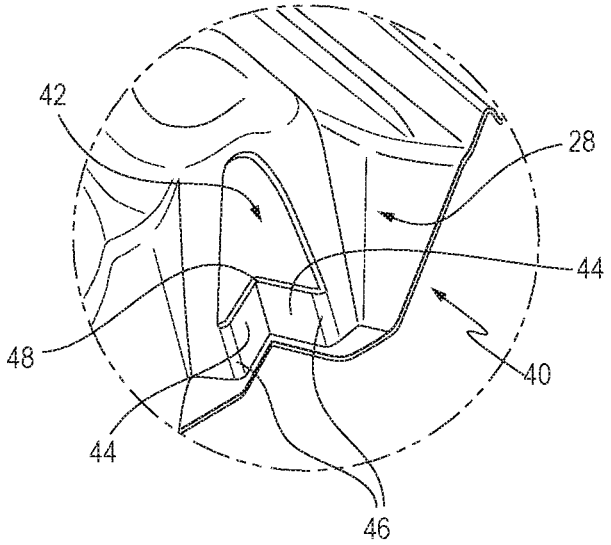
FIG. 11A is a partial perspective view of an accordion component of a locking means for a modular carrier in accordance with one embodiment of the present invention.
Figure 11B:
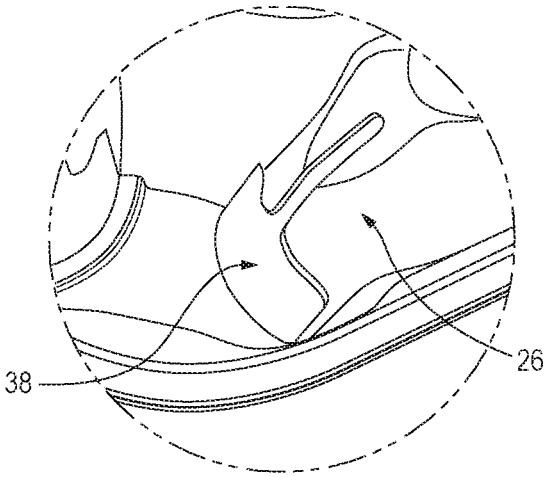
FIG. 11B is a partial perspective view of a receiving slot of a locking means for a modular carrier in accordance with one embodiment of the present invention.
Figure 11C:
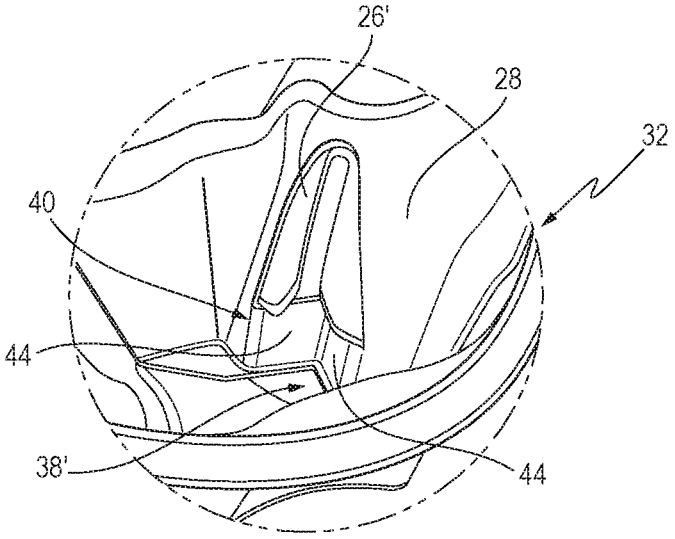
FIG. 11C is a partial perspective view of the locking means of FIGS. 11A and 11B illustrating the locking means connected together in an assembled modular carrier in accordance with one embodiment of the present invention.
Figure 12:
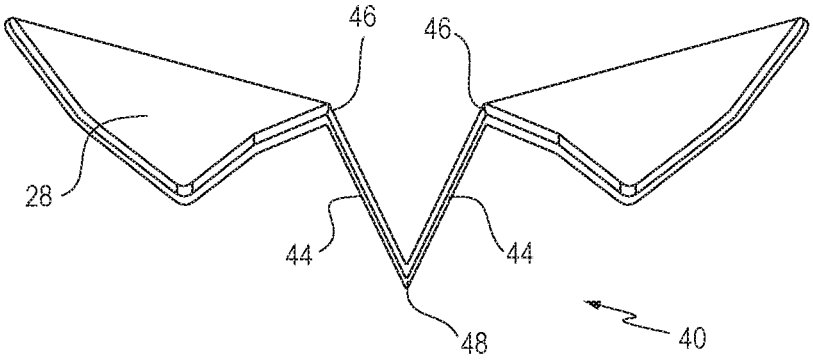
FIG. 12 is a schematic diagram view of the accordion component of FIG. 11A.
Figure 13:
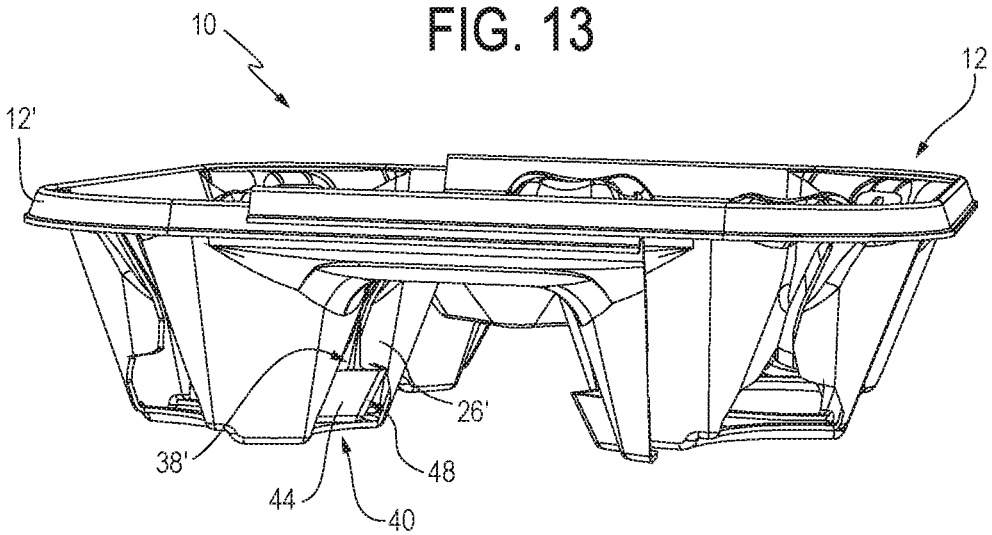
FIG. 13 is a perspective view of an assembled modular carrier illustrating the locking means of FIGS. 11A-11C.

Turning to FIGS. 11-13, second locking means 32 will be now be described in greater detail. As best shown in FIG. 11A, second locking means 32 can include an accordion panel component 40 provided on the second sidewall segment 28 of modular component 12. The several figures illustrate various embodiments of the present invention where second locking means 32 includes two accordion panel components 40; however, any number or configuration of accordion panel components 40 can be utilized in alternative embodiments of the present invention. As best shown in FIG. 11A, each accordion panel component 40 can include a slot 42 defined into second sidewall segment 28 and two panels 44 extending from the edges of slot 42 and into slot 42. As shown, each of the panels 44 can be connected to one edge of slot 42 by a hinge line or fold line 46. In addition, the two panels 44 can be connected together within slot 42 by an intermediate hinge line or fold line 48, as best shown in FIGS. 11A and 12. Collectively, the hinge lines 46 and intermediate hinge line 48 enable the panels 44 to angle inward at a varying degree and allow the accordion panel component 40 expand and retract depending on the external forced applied to the second sidewall 28. In particular, the intermediate fold line 48 permits the panels 44 to flatten outward (due to the reduced rigidity) and thereby widen the width of slot 42 and increase the expansion of second sidewall segment 28.

As best shown in FIG. 11B (and also FIG. 13), second locking means 32 can further include a receiving slot 38 provided on first sidewall segment 26 at a location corresponding to the location of accordion panel component 40 provided on second sidewall segment 28. The several figures illustrate various embodiments of the present invention where first sidewall segment 26 of modular component 12 includes two receiving slots 38 (which correspond to the two accordion panel components 40 provided on second sidewall segment 26); however, any number of receiving slots 38 can be utilized in alternative embodiments of the present invention. As best illustrated by FIGS. 11A-11C, each receiving slot 38 included on first sidewall segment 26 can correspond to an accordion panel component 40 provided on second sidewall segment 28 so that when two modular components 12 are connected together (see FIG. 11C) and the first and second sidewall segments 26 and 28 are aligned and overlap one another, each accordion panel component 40 on the second sidewall segment 28 aligns with a corresponding receiving slot 38 on the first sidewall segment 26. Receiving slot 38 can be configured into any suitable or desired shape (such as an inverted T-shaped slot as shown in the several figures, or any other suitable slot shape) where at least a portion of the slot 38 has a width approximately equal to the width of accordion panel component 40 to allow the panels 44 of accordion panel component 40 to be received within receiving slot 38 (as best shown in FIGS. 11C and 13).

As best illustrated in FIGS. 7, 9, 11C and 13, when two modular components 12 and 12' are connected together and the second sidewall segment 28' of the first modular component 12 (i.e., the overlapping modular component in this embodiment) aligns with and overlaps the first sidewall segment 26 of the second modular component 12' (i.e., the underlapping modular component in this embodiment), the accordion panel component 40 on the second sidewall segment 28 of overlapping first modular component 12 can be inserted into and received by the receiving slot 38' of the first sidewall segment 26' of the underlapping second modular component 12'. The expandable feature of the accordion panel component 40 allows it to expand within the receiving slot 38' (due to the pivoting of panels 44 about hinge lines 46 and 48) and create an interference fit between the panel component 40 and slot 38'. As further illustrated in the figures, receiving slot 38' can include a flaps or extended portions above the portion of the slot 38' that receives accordion panel 40. These flaps can assist in creating a further interference fit with accordion panel 40 by extending through the opening in second sidewall segment 28 above accordion panel 40.

The intermediate hinge line 48 can prevent the component 40 from being urged back into a constricted configuration (such as if panels 44 comprised a single flattened or curved panel), and therefore assist in maintaining a strong interference fit between the panel component 40 and slot 38'. In addition, the expansion of the accordion panel component 40 expands the second sidewall segment 28 relative to first sidewall segment 26' to create a compression force across the entire length of the sidewall segments 26' and 28 due to the conforming fit between the segments 26' and 28'.

As described above, the accordion panel component 40 may be configured to expand when a force is applied to the second sidewall segment 28. This expansion can create an interference and interlocking fit between the first and second sidewall segments 26 and 28 of two modular components 12 and 12' (see FIGS. 11C and 13). In addition, the interference and interlocking fit becomes greater when a larger force is applied to the sidewall segments 26 and 28. As a result, when modular carrier 10 is lifted or being held by a user, a force is applied to the segments 26 and 28, thereby causing expansion of the accordion panels 40 and creating an interlocking fit through second locking means 32 to assist in keeping the modular components 12 and 12' together and hold modular carrier 10 in a rigid shape. Further, when a food and/or drink item or container is placed in the receiving region 16 of either modular component 12 or 12', the force applied to the sidewall segments 26' and 28 may be increased, thereby increasing the expansion of the accordion panel 40 and increasing the interference and interlocking fit of the second locking means 32, which further stabilizes the modular components 12 and 12' together to maintain the rigidity of modular carrier 10.

Turning now to FIGS. 14-17, buttress support means 100, which may be incorporated into modular components 12 forming a modular carrier 10 (as shown in FIGS. 1-10) will be described in greater detail. Buttress support means 100 can be utilized in conjunction with the first and second locking means 30 and 32, respectively, to provide additional support and rigidity to modular carrier 10 under various different types of loading conditions.

Figure 14:
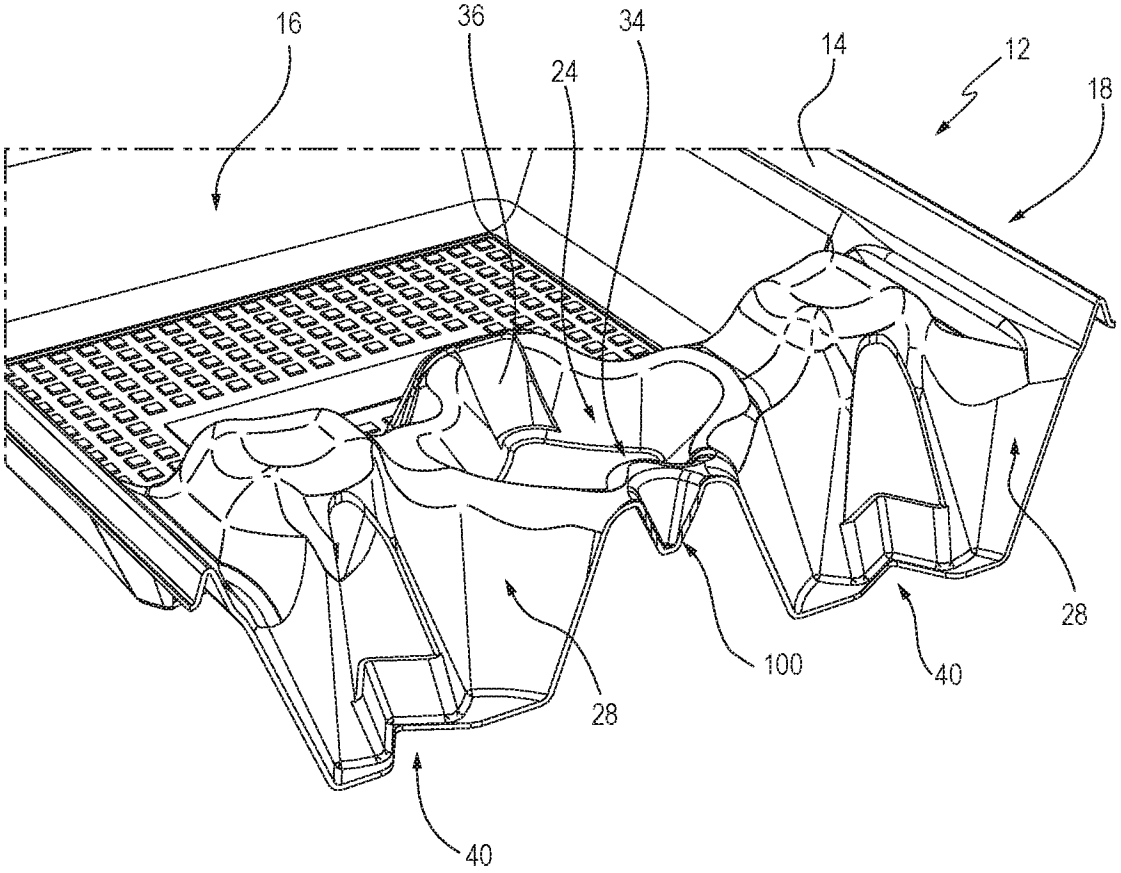
FIG. 14 is a partial perspective view of a modular component for a modular carrier illustrating buttress support means provided on the modular component in accordance with one embodiment of the present invention.
Figure 15:
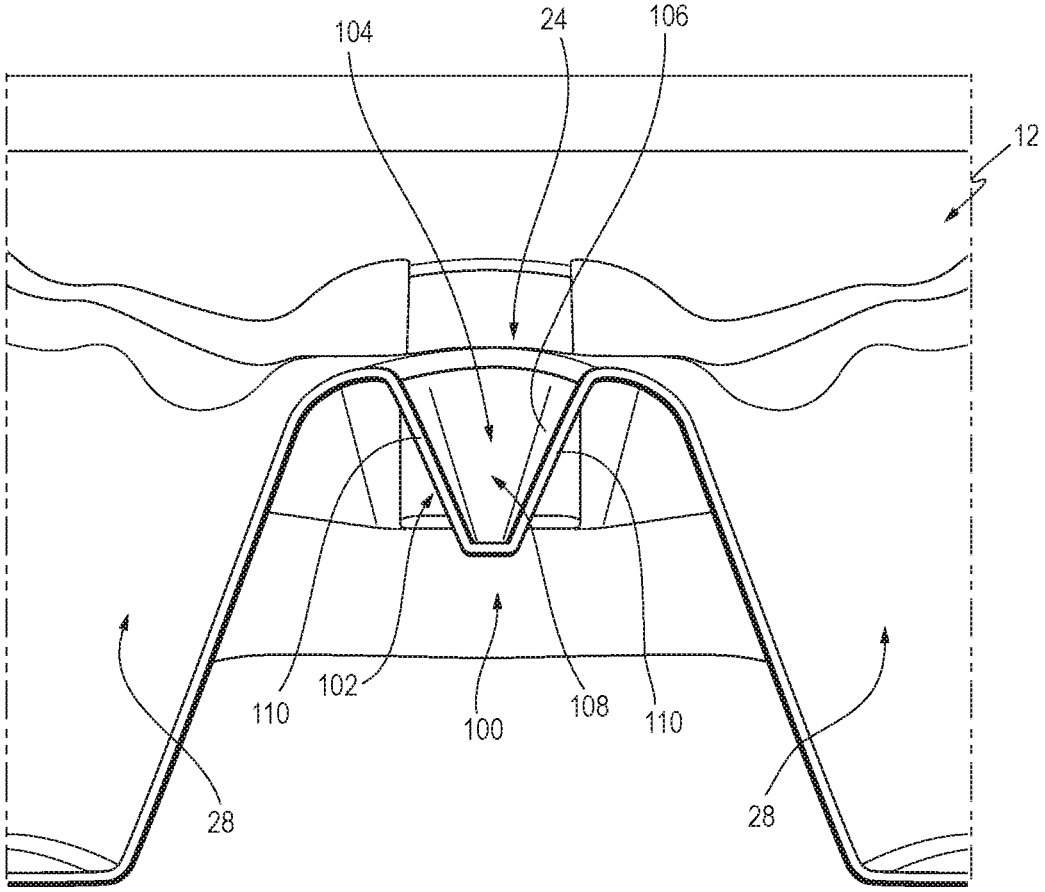
FIG. 15 is a partial perspective view of the buttress support means of FIG. 14.

As best shown in FIGS. 14, buttress support means 100 can be positioned along the edge of divider well 24 along second sidewall segment 28 adjacent to the exterior side of protrusion 34 of first locking means 30. As best shown in FIGS. 14 and 15, the buttress support means 100 can include an engaging edge 102 and a brace or support structure 104 defined into divider well 24 and second sidewall segment 28 of a modular component 12. As best shown in FIG. 15, support structure 104 can extend inward (toward the interior of divider well 24) from engaging edge 102 and can be configured as a semi-spherical indention defined into the upper portion of divider well 24 and second sidewall segment 28; however, it is recognized that support structure 104 can also have any desired indention-type shape or other configuration. According to one embodiment, as best shown in FIG. 15, supporting structure 104 can include support sidewall 106 extending inward from engaging edge 102 and second sidewall segment 28 and into divider well 24 in order to create an indention 108 within divider well 24. Support structure 104 can be configured to provide rigidity to engaging edge 102 (and buttress support means 100 overall) in order to strengthen engaging edge 102 and restrict engaging edge 102 from folding, bending or otherwise deforming when force or pressure is applied to engaging edge 102 (as described in greater detail below).

As best shown in FIG. 15, engaging edge 102 can extend along the edge of second sidewall segment 28 adjacent to supporting structure 104 and include downwardly depending edge sections 110 along support sidewall 106. As described in greater detail below, engaging edge 102 (and edge sections 110) can be configured to contact and engage an upper perimeter edge 112 (see FIG. 16) of the slot 36 of first locking means 30 when two modular components 12 and 12' are connected together. According to one embodiment, edge sections 110 have an angled orientation so that edge sections 110 are further apart at the upper portion of buttress support means 100 and engaging edge 102 and closer together at the lower portion of buttress support means 100 and engaging edge 102. This configuration can assist in maintaining the rigidity of engaging edge 102 and buttress support means 100 overall when force or pressure is applied to engaging edge 102 toward the lower portion of buttress support means 100 and further away from divider well 24, which can provide additional rigidity to engaging edge 102 toward the upper portion of buttress support means 100.

Figure 16:
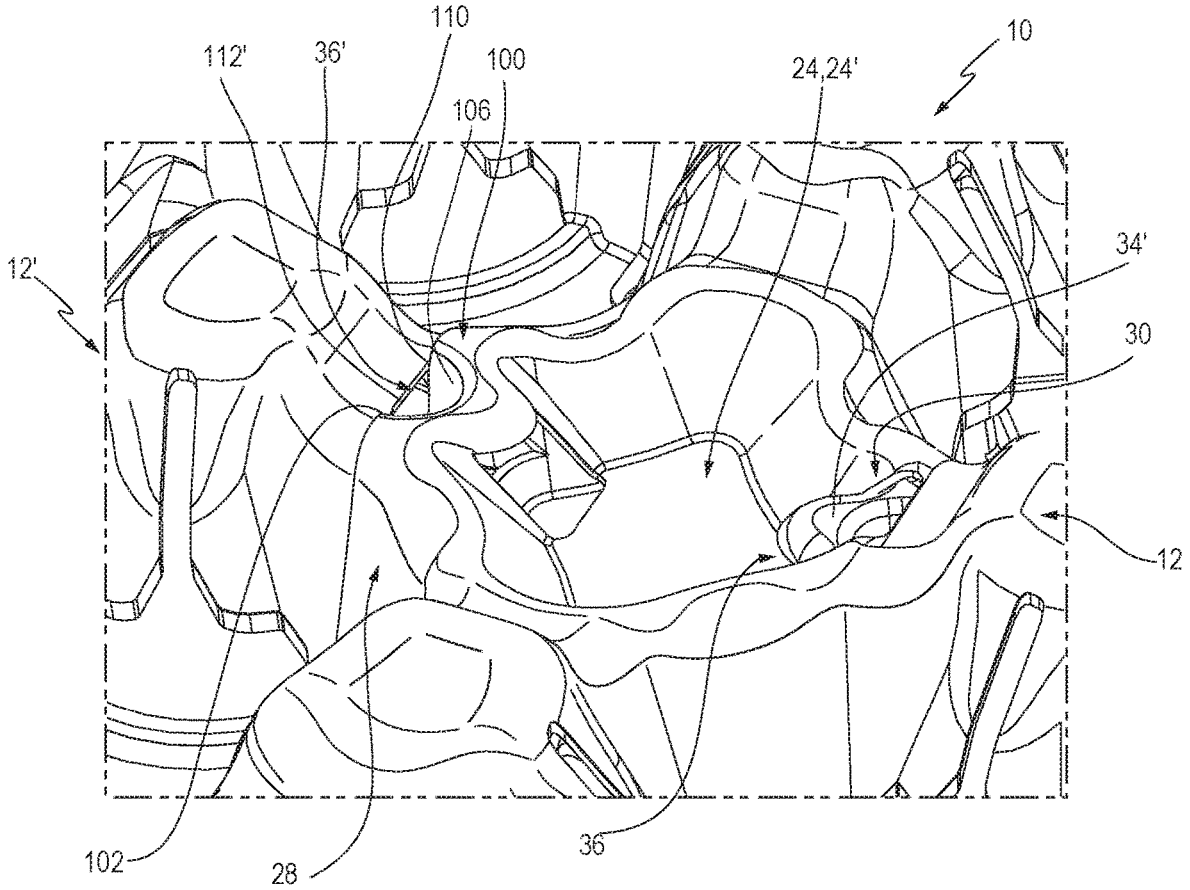
FIG. 16 is a partial perspective view of an assembled modular carrier with a buttress support means in accordance with one embodiment of the present invention.

As best shown in FIG. 16, when a first (overlapping) modular component 12 is connected to a second (underlapping) modular component 12' by placing the first modular component 12 over the second modular component 12' in an overlapping relationship, the protrusion 34' of the second modular component 12' can be inserted underneath and through the slot 36 of the first modular component 12 (forming first locking means 30) on one side of the overlapped divider wells 24 and 24'. In addition, on the opposite side of the overlapped divider wells 24 and 24' for each modular component 12 and 12', the buttress support means 100 of the first modular component 12 can be positioned adjacent to the slot 36' of the second modular component 12'.

As shown in FIG. 16, slot 36' of the second modular component 12' includes an upper perimeter edge 112' located near the upper end of first sidewall segment 26' of the second modular component 12'. When first and second modular components 12 and 12' are connected together, the upper end portion of second sidewall segment 28 of the first modular component 12 can generally align with upper perimeter edge 112' of slot 36' on the second modular component 12' due to the generally conforming fit and overlapping relationship of the two modular components 12 and 12'. In this position, buttress support means 100 of the first modular component 12 (and particularly engaging edge 102) may align is aligned with and adjacent to the upper perimeter edge 112' of slot 36' of the second modular component 12'. This arrangement allows the downwardly depending edge sections 110 of the engaging edge 102 to contact the upper perimeter edge 112' of the slot 36' and create a bracing or supporting relationship between the buttress support means 100 of the first modular component 12 and the slot 36' of the second modular component 12'.

Figure 17A:
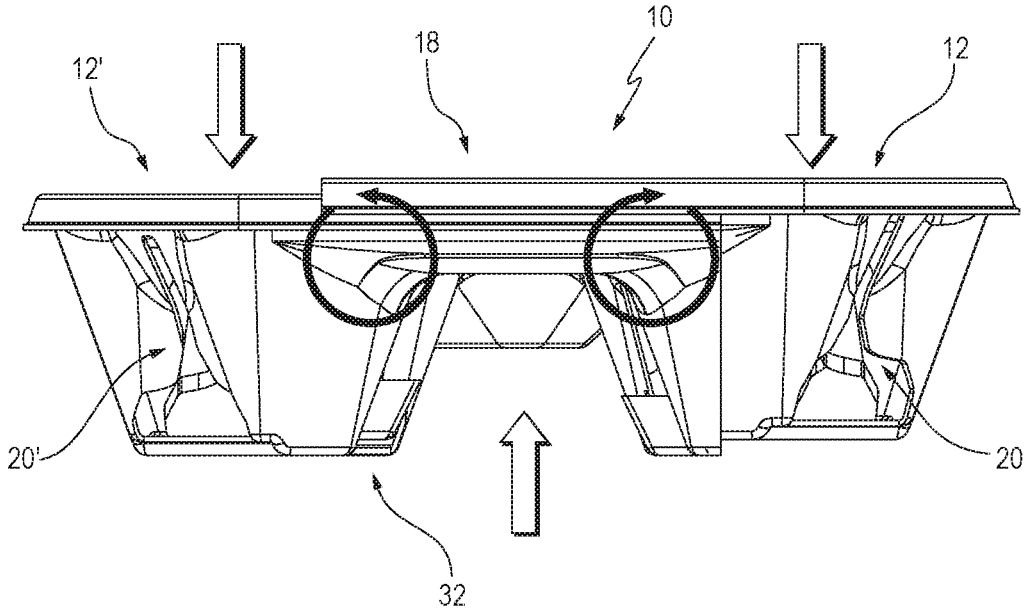
FIG. 17A is a schematic diagram view of an assembled modular carrier under a first loading condition in accordance with one embodiment of the present invention.
Figure 17B:
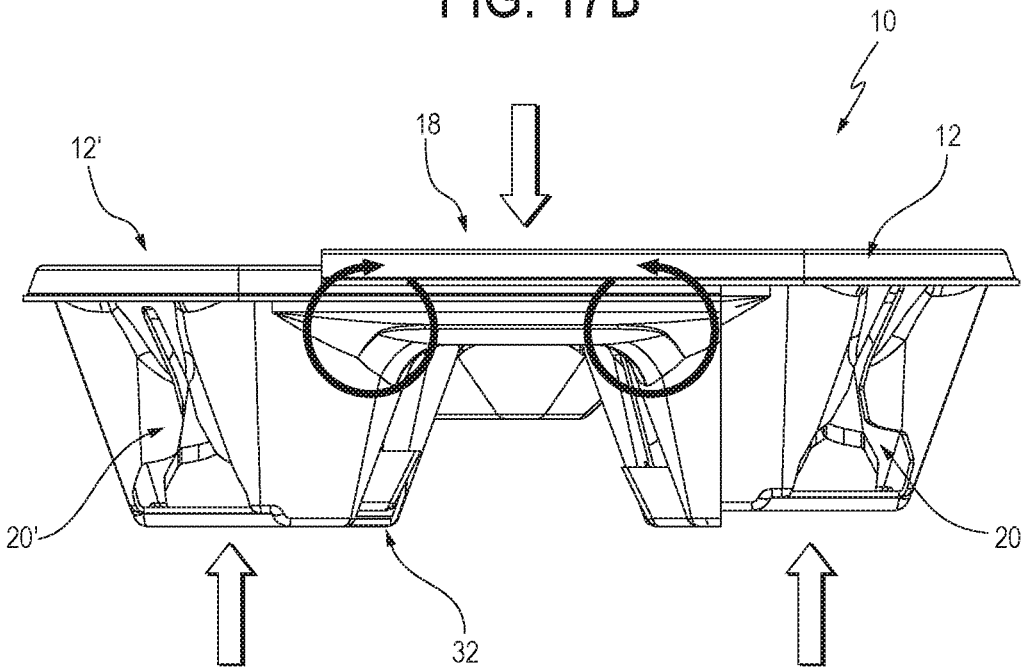
FIG. 17B is a schematic diagram view of an assembled modular carrier under a second loading condition in accordance with one embodiment of the present invention.
Figure 17C:
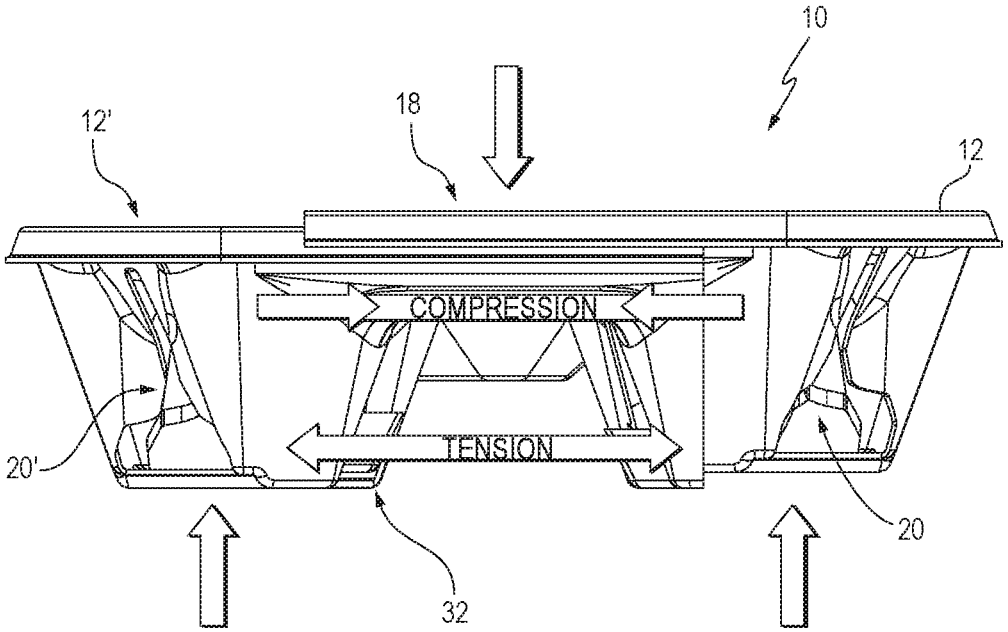
FIG. 17C is a schematic diagram view of the modular carrier of FIG. 17B illustrating the forces acting on the modular carrier in accordance with one embodiment of the present invention.

FIGS. 17A-17C along with FIGS. 7-13 illustrate the interaction of buttress support means 100 in conjunction with first and second locking means 30 and 32 during loading conditions of modular carrier 10 will be described in greater detail in accordance to one embodiment of the present invention. As best illustrated in FIGS. 7, first locking means 30 connects first and second modular components 12 and 12' by allowing the protrusion 34' of second modular component 12' to project below and through slot 36 of first modular component 12 (which overlaps second modular component 12'). As further illustrated in FIG. 7 (and also FIGS. 11A-11C), second locking means 32 connects first and second modular components 12 and 12' by allowing accordion panels 40 of first modular component 12 to project through and under undercut receiving slot 38' of second modular component 12'. As best shown in FIG. 14, buttress support means 100 located on first modular component 12 does not project under or beneath slot 36' (located in divider well 24) of second modular component 12', but rather abuts against slot 36'.

In this configuration, engaging edge 102 of buttress support means 100 engages the upper perimeter edge 112' of slot 36' and supporting portion 104 of buttress support means 100 provides structural support to engaging edge 102 (and edge sections 110).

Turning now to FIGS. 17A-17C, during normal use of modular carrier 10, the linked first and second modular components 12 and 12' will be subjected to a bending load as a result of the food, drink or other items placed into the container wells 20 and/or food compartment(s) 22. FIG. 17C schematically shows a first common use situation according to one embodiment. In this first use situation, the weight of drink containers (and/or food items) held by the modular carrier 10 applies a downward load to the container wells 20 (depending on the particular configuration of modular carrier 10) on the outer receiving portions 16 of each modular component 12 and 12' and the modular carrier 10 is supported by a user from underneath the modular carrier 10. These offset forces (represented as vertical arrows) create a torque (represented as circular arrows) to the first and second modular components 12 and 12' in opposite directions of rotation as illustrated in FIG. 17A. The torque created on the first modular component 12 attempts to rotate first modular component 12 in a clockwise direction, which urges to raise the overlapping portion 18 of first modular component 12. This upward movement can be prevented by the second locking means 32, where the accordion panels 40 of first modular component 12 are positioned underneath and through the receiving slot 38' of the second modular component 12' and therefore engage and interlock with the receiving slot 38' to restrict the upward movement of the first modular component 12 with respect to the second modular component 12'. First locking means 30 located within the overlapped divider wells 24 and 24 can further assist in preventing disengagement of first and second modular components 12 and 12' due to the interlocking fit of protrusion 34' of second modular component 12' and slot 36 of first modular component 12.

FIGS. 17B and 17C schematically show a second common use situation where the downward force applied to modular carrier 10 is in the central overlapping regions 18 and 18' of the first and second modular components 12 and 12' and the upward force is applied to the modular carrier 10 beneath the receiving portions 16 and 16' of the first and second modular carriers 12 and 12'. In this situation, the downward and upward forces create torque in the clockwise direction for the second modular component 12' (i.e., the underlapping modular component), which urges the receiving portion 16' in the upward direction. In such a scenario, the second locking means 32 does not act to restrict the displacement of the receiving portion 16' of the second modular component 12'. As best illustrated in FIG. 17C, in response to the applied loads on modular carrier 10, the upper region of modular carrier 10 is placed into compression and the lower region of modular carrier 10 is placed in tension. Under these loading conditions, buttress support means 100 can limit displacement and deflection between the two modular components 12 and 12' and maintain the structural effectiveness of modular carrier 10. Buttress support means 100 can be incorporated into first locking means 30 (along the exterior side of protrusion 34 of the overlapping modular component 12 that is not utilized in the connection of first locking means 30) in divider well 24 to restrict the compression forces generated in the upper region of modular carrier 10. As described above, the engaging edge 102 of buttress support means 100 of the first modular component 12 can engage the upper perimeter edge 112' of the slot 36' of the divider well 24' of the second modular component 12' (i.e., the underlapping modular component 10). When engaging edge 102 of buttress support means 100 abuts up against perimeter edge 112' of slot 36', the compressive forces in the upper region of modular carrier 10 are counteracted and deflection between modular components 12 and 12' is restricted.

As illustrated in the several figures, buttress support means 100 does not require any latching action or insertion of components between first and second modular components 12 and 12' (as with first and second locking means 30 and 32). Buttress support means 100 may be formed into divider well 24 adjacent to protrusion 34 and along the upper perimeter edge of second sidewall segment 28 (on the exterior side of protrusion 34). Under loading conditions where the upper portion of modular carrier 10 is placed into compression as described above. Under these conditions, first and second locking means 30 and 32 may accidentally disengage if protrusion 34 and/or accordion panel component 40 are not properly secured within slot 36 and/or slot 38, respectively. Buttress support means 100 can function as a bracing mechanism that does not rely on the insertion of any components, which can provide for greater reliability of modular carrier 10 in many different loading conditions.

From the foregoing, it will be seen that this invention is one well adapted to attain all the ends and objects hereinabove set forth together with other advantages which are obvious and which are inherent to the structure. It will be understood that certain features and sub combinations are of utility and may be employed without reference to other features and sub combinations. This is contemplated by and is within the scope of the claims. Since many possible embodiments of the invention may be made without departing from the scope thereof, it is also to be understood that all matters herein set forth or shown in the accompanying drawings are to be interpreted as illustrative and not limiting.

The constructions described above and illustrated in the drawings are presented by way of example only and are not intended to limit the concepts and principles of the present invention. Thus, there has been shown and described several embodiments of a novel invention. As is evident from the foregoing description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required". Many changes, modifications, variations and other uses and applications of the present construction will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

What is claimed is:

1. A modular carrier for at least one of food and drink, said modular carrier comprising:

a first modular component including a first receiving region for holding at least one food or drink item and a first overlapping region;

a second modular component including a second receiving region for holding at least one food or drink item and a second overlapping region; and at least one locking means provided on each of said first and said second overlapping regions, said at least one locking means comprising an accordion panel component, said accordion panel component comprising at least a first panel and a second panel, wherein said first and second panels are connected together by a hinge line;

wherein said first and said second modular components are configured to be connected together by placing said first overlapping region over said second overlapping region.

2. The carrier of claim 1, wherein said first modular component is configured to hold a different type of food or drink item than said second modular component.

3. The carrier of claim 1, wherein each of said overlapping regions comprises a divider well, a first sidewall segment extending away from said divider well and connecting to said receiving region, and a second sidewall segment extending from said divider well opposite said first sidewall segment.

4. The carrier of claim 3, wherein said at least one locking means comprises said accordion panel component on said second sidewall segment and a receiving slot component provided on said first sidewall segment.

5. The carrier of claim 4, wherein said accordion panel component and said receiving slot component are generally aligned so that when said overlapping region of said first modular component is connected to said overlapping region of said second modular component, said accordion panel component on said first modular component is received within said receiving slot component of said second modular component.

6. The carrier of claim 5, wherein said accordion panel component is configured to expand within said receiving slot component and create an interference fit between said first and said second overlapping regions of said first and said second modular components when said first and said second modular components are connected together.

7. The carrier of claim 1, wherein said first modular component includes a second locking means provided on said first overlapping region and said second modular component includes a second locking means provided on said second overlapping region, wherein each of said first and said second overlapping regions comprises a divider well, wherein said second locking means of each of said first and said second modular components comprises:

a protrusion extending from a perimeter edge of said divider well toward the center of said divider well; and a slot located on an opposite side of said perimeter edge of said divider well;

wherein said protrusion of said second locking means of said second modular component is inserted through said slot of said second locking means of said first modular component when said first and said second modular components are connected together.

8. A modular carrier for at least one of food and drink, said modular carrier comprising:

a first modular component including a first receiving region for holding at least one food or drink item and a first overlapping region;

a second modular component including a second receiving region for holding at least one food or drink item and a second overlapping region;

a buttress support means provided on said first modular component, said buttress support means comprising an engaging edge and a support structure, said engaging edge configured to engage an upper perimeter edge of a slot defined in said second modular component; and at least one locking means provided on each of said first and said second overlapping regions, said at least one locking means of each of said first and said second overlapping regions comprising an accordion panel component, said accordion panel component comprising at least a first panel and a second panel, wherein said first and second panels are connected together by a hinge line;

wherein said first and said second modular components are configured for being connected together by placing said first overlapping region over said second overlapping region.

9. The carrier of claim 8, wherein said first modular component is configured to hold a different type of food or drink item than said second modular component.

10. The carrier of claim 8, wherein each of said overlapping regions comprises a divider well, a first sidewall segment extending away from said divider well and connecting to said first or said second receiving region corresponding to said first or said second modular component, and a second sidewall segment extending from said divider well opposite the first sidewall segment.

11. The carrier of claim 10, wherein said buttress support means is located adjacent said divider well along said second sidewall segment.

12. The carrier of claim 10, wherein said engaging edge of said buttress support means is located on said second sidewall segment.

13. The carrier of claim 8, wherein said engaging edge of said buttress support means comprises two side edge sections, wherein said two side edge sections have a downwardly angled orientation.

14. The carrier of claim 8, wherein said support structure of said buttress support means comprises an indention.

15. A modular component for use in a modular carrier for at least one of food and drink, said modular component comprising:

a receiving region and an overlapping region, said overlapping region having a sidewall segment and a divider well connecting said sidewall segment to said receiving region;

a buttress support means configured for stabilizing the modular carrier when subjected to a loading condition, said buttress support means comprising an engaging edge on said sidewall segment; and a locking means formed into said sidewall segment, said locking means comprising an accordion panel component formed into an opening along said sidewall segment;

wherein said modular component is configured to be interconnected with a second modular component to construct the modular carrier.

16. The modular component of claim 15, wherein said buttress support means further comprises a support structure extending inward from said engaging edge, said support structure forming an indention.

17. The modular component of claim 15, wherein said engaging edge comprises two side edge sections, wherein said two side edge sections have a downwardly angled orientation.

18. The modular component of claim 15, wherein said accordion panel component is configured to engage a receiving slot located on said second modular component when constructing the modular carrier.

* * * * *